US010344454B2

(12) United States Patent
Chioccola

(10) Patent No.: US 10,344,454 B2
(45) Date of Patent: Jul. 9, 2019

(54) SYSTEM FOR COORDINATING THE DIRECTION OF TRAVEL OF A HYDRAULIC MACHINE WITH THE OPERATOR'S POSITION

(71) Applicant: CNH Industrial America LLC, New Holland, PA (US)

(72) Inventor: Francesco Chioccola, Settimo Torinese (IT)

(73) Assignee: CNH Industrial America LLC, New Holland, PA (US)

( * ) Notice: Subject to any disclaimer, the term of this patent is extended or adjusted under 35 U.S.C. 154(b) by 232 days.

(21) Appl. No.: 15/316,454

(22) PCT Filed: Jun. 4, 2015

(86) PCT No.: PCT/EP2015/062521
§ 371 (c)(1),
(2) Date: Dec. 6, 2016

(87) PCT Pub. No.: WO2015/185699
PCT Pub. Date: Dec. 10, 2015

(65) Prior Publication Data

US 2017/0152645 A1 Jun. 1, 2017

(30) Foreign Application Priority Data

Jun. 6, 2014 (IT) ..... MO2014A0165

(51) Int. Cl.
*E02F 9/20* (2006.01)
*E02F 9/22* (2006.01)
(Continued)

(52) U.S. Cl.
CPC ..... *E02F 9/2025* (2013.01); *E02F 9/02* (2013.01); *E02F 9/2037* (2013.01); *E02F 9/225* (2013.01);
(Continued)

(58) Field of Classification Search
CPC ..... E02F 9/225; E02F 9/2037
See application file for complete search history.

(56) References Cited

U.S. PATENT DOCUMENTS 3,990,527 A 11/1976 Inui et al.
4,163,413 A * 8/1979 Kennicutt ..... B62D 11/183 180/6.48

FOREIGN PATENT DOCUMENTS

CN 1497105 A 5/2004
CN 102051895 A 5/2011
(Continued)

*Primary Examiner* — F Daniel Lopez
(74) *Attorney, Agent, or Firm* — Peter K. Zacharias; Patrick M. Sheldrake

(57) ABSTRACT

A system for automatically coordinating a direction of travel with a position of a turret rotatably mounted on an undercarriage of a hydraulic machine including a hydraulic transmission circuit for connecting a main pump to a bi-directional hydraulic travel motor. The circuit includes a travel control distributor able to vary a driving direction of the motor. The system includes a second hydraulic circuit disposed downstream of a pilot pump providing a pilot pressure. The second circuit includes: a valve controller for controlling a direction of travel, activatable by the operator and able to switch the control distributor by sending different command signals; and a reversing valve, interposed between the valve controller and the control distributor. The system further includes a coordination circuit able to switch or maintain the reversing valve according to the position of the turret and to the command signals.

11 Claims, 7 Drawing Sheets

Figure 1:
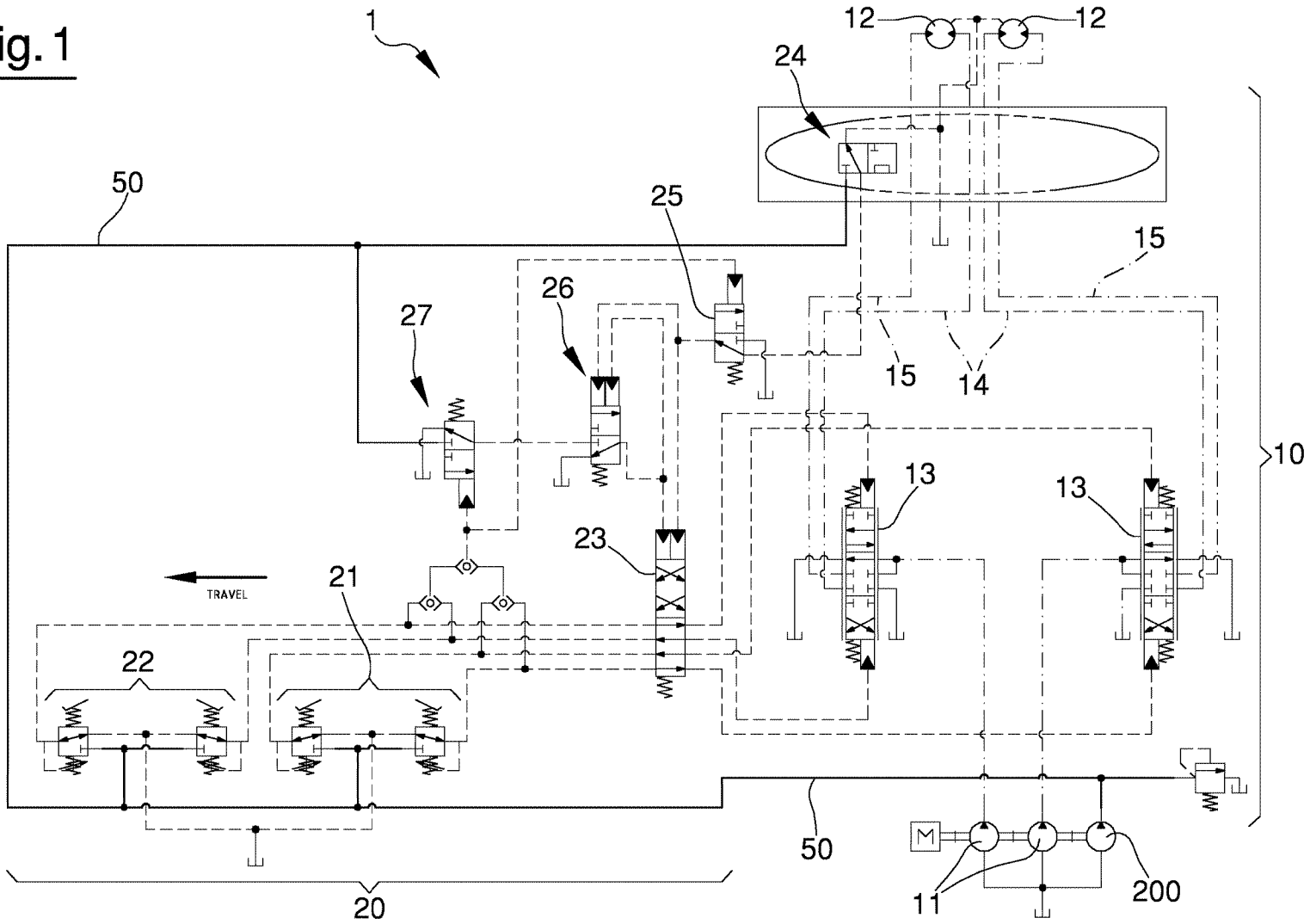

(51) Int. Cl.

| | |
|---|---|
| ***E02F 9/02*** | (2006.01) |
| ***F15B 9/17*** | (2006.01) |
| ***F15B 13/02*** | (2006.01) |
| ***F15B 13/07*** | (2006.01) |

(52) U.S. Cl.
CPC ..... *E02F 9/2228* (2013.01); *E02F 9/2285* (2013.01); *E02F 9/2292* (2013.01); *F15B 9/17* (2013.01); *F15B 13/022* (2013.01); *F15B 13/07* (2013.01)

(56) References Cited

FOREIGN PATENT DOCUMENTS

| | | | |
|---|---|---|---|
| DE | 4301745 | C1 | 6/1994 |
| EP | 0423372 | | 4/1991 |
| JP | S5748044 | A | 3/1982 |
| JP | S57143020 | A | 9/1982 |
| KR | 20110075556 | A | 7/2011 |
| WO | 2013117053 | A1 | 8/2013 |

* cited by examiner

SYSTEM FOR COORDINATING THE DIRECTION OF TRAVEL OF A HYDRAULIC MACHINE WITH THE OPERATOR'S POSITION

This application is the National Stage of International Application No. PCT/EP2015/062521 filed Jun. 4, 2015, which claims priority to Italian Application No. MO2014A000165 filed Jun. 6, 2014, the contents of which are incorporated herein by reference.

The present invention relates to a system for automatically coordinating the direction of travel with the operator's position in a hydraulic machine, where the driving cab is housed in a rotating turret.

In detail, the invention is especially intended for use in earthmoving machinery, such as, for example, excavators or the like.

As is well known, excavators, like all other similar machines, are provided with an upper frame (or "turret"), where the operator cab is located; the cab is rotatably mounted on an undercarriage, for example of the type with tracks.

At present, the direction of forward travel is defined in an absolute and non-intuitive manner.

More precisely, in a first position of the turret relative to the undercarriage, in order to obtain forward travel of the machine, the operator must move forward two levers in the cab, before actuating the motors of the undercarriage.

In order to obtain reverse travel, the operator must move the levers backward.

Conversely, when the turret is rotated by 180° relative to the first position, the forward travel of the vehicle, i.e. travel in a frontward direction relative to the operator, is possible only by moving the levers backward.

After repeated rotations of the turret, the operator can lose his orientation and become confused as to the position of the turret relative to undercarriage.

This circumstance can cause accidents, also very serious ones.

In fact, the operator risks driving the vehicle in the wrong direction of travel, i.e. opposite to the one desired.

At present, the operator uses as his reference the position of the motors in the undercarriage and, before moving the levers and then actuating the motors, he observes and assesses their position relative to the turret and decides accordingly.

However, this solution is not at all effective, because it does not eliminate in any case the risk that the operator may become confused and therefore that accidents will be caused.

The technical task at the basis of the present invention is to propose a system for coordinating the direction of travel with the position of the turret of a hydraulic machine which overcomes the drawbacks listed above.

The stated technical task and the specified object are achieved by the system realized in accordance with claim 1.

Figure 5:
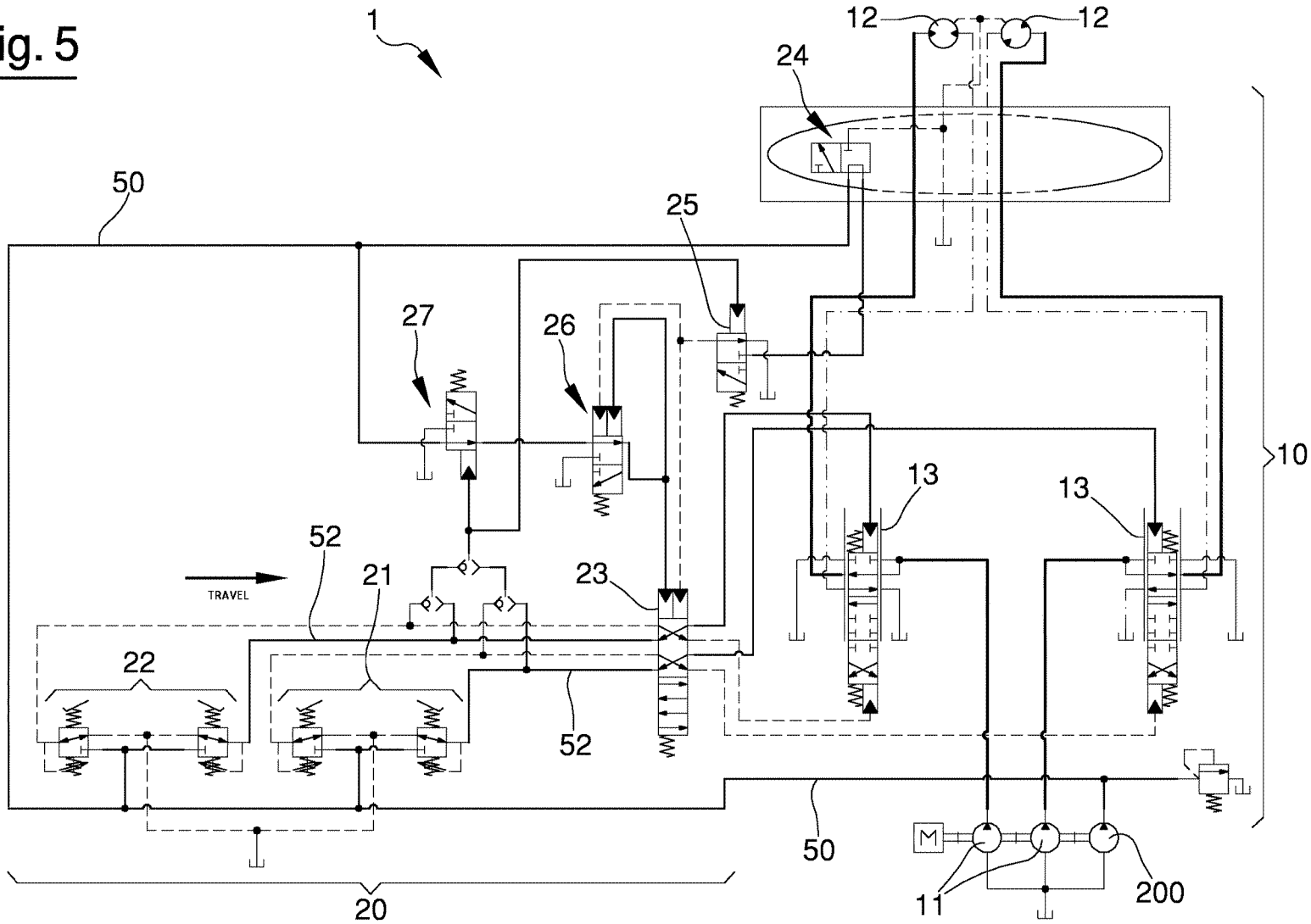
Figure 6:
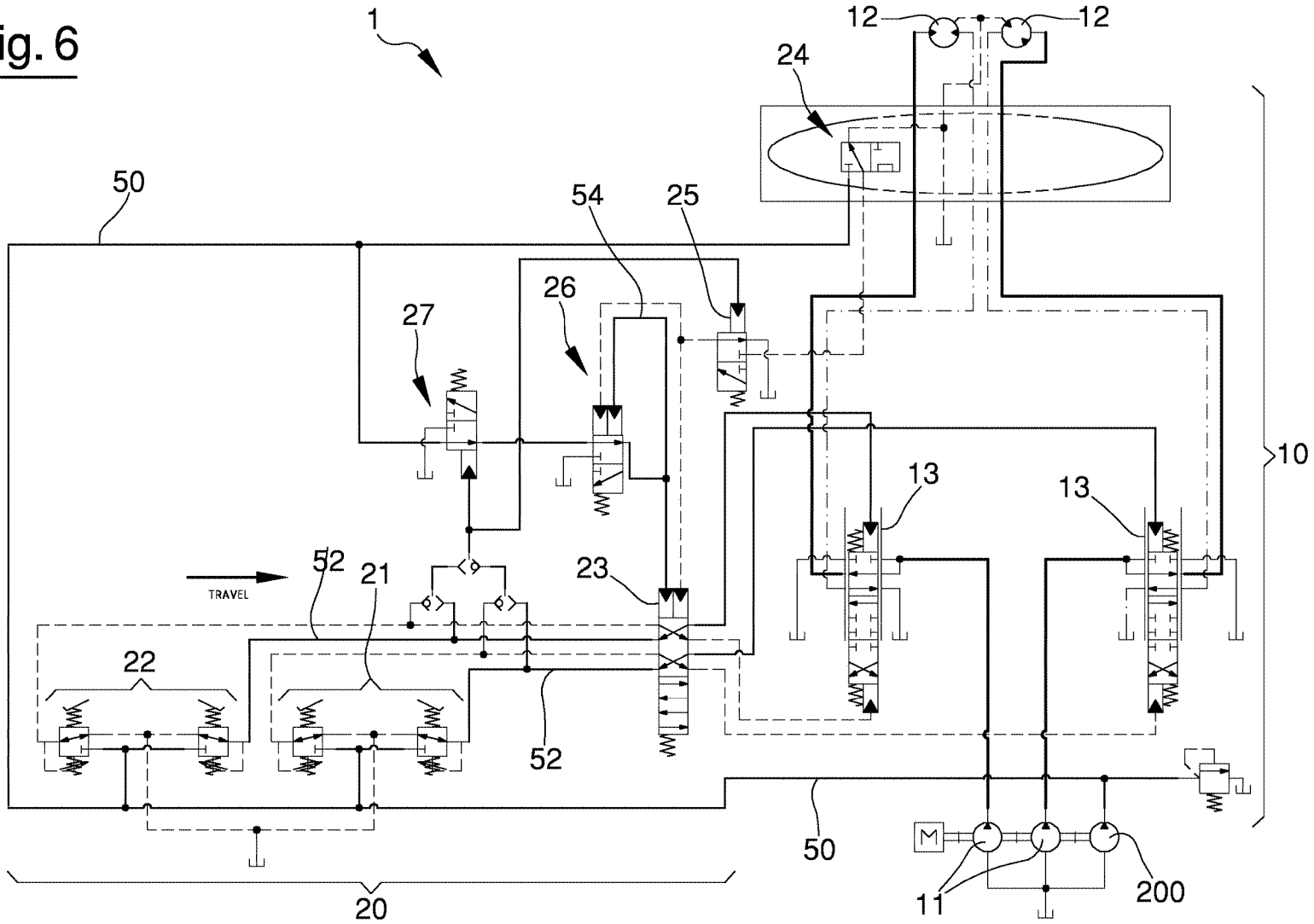
Figure 7:
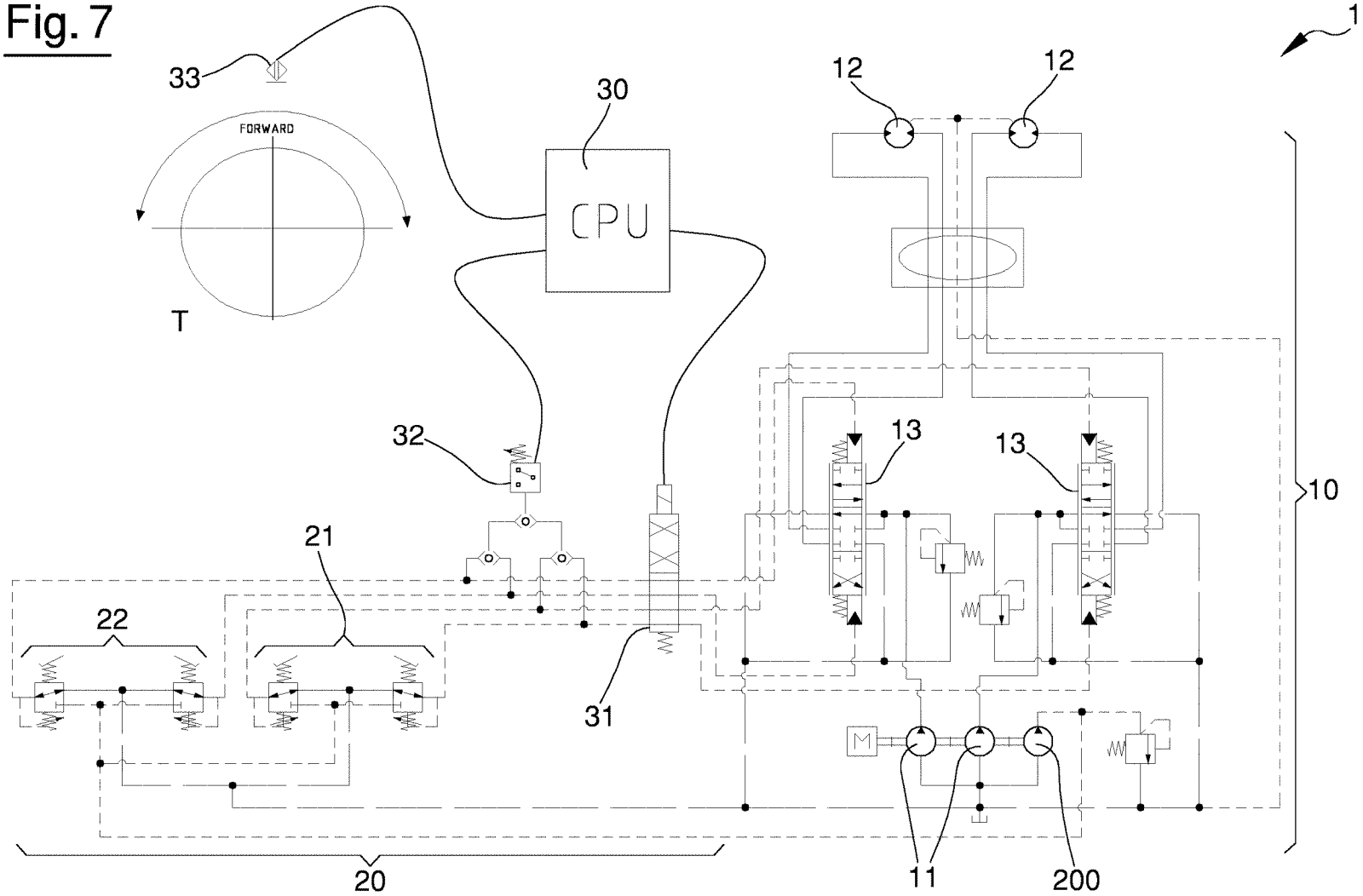

Additional features and advantages of the present invention will be more apparent from the approximate, and thus non-limiting, description, of a preferred, but not exclusive embodiment of the system for coordinating the direction of travel with the position of the turret of a hydraulic machine, as illustrated in the appended drawings in which:

FIGS. 1-6 are schematic representations of a first embodiment of the system of the invention, under different operating conditions; and FIG. 7 is a schematic representation of a second embodiment of the invention.

With reference to the aforementioned figures, 1 indicates the coordination system of the invention.

The system 1 has been devised to automatically coordinate the direction of travel of a hydraulic machine with the position of the driving cab housed by the turret, and thus with the operator's position.

In detail, the invention makes it possible to associate, in an automatic and intuitive manner, the direction of forward travel of the vehicle with the operator's position, thus surpassing the approach of the prior art, which envisages an absolute direction of forward travel.

The system 1 is especially intended for use in an earthmoving or agricultural machine comprising an undercarriage, for example with tracks, whereupon there is rotatably mounted a turret, which rotates around a vertical axis.

An articulated excavator arm, equipped with a digging tool, such as a bucket or the like, is mounted on the turret.

As will be clear in the discussion of the operation of the system 1, the invention enables the direction of forward travel of the machine to be associated with the subjective frontward direction of the operator.

For the sake of descriptive convenience, the turret is conventionally defined to be in the frontward position when the excavator arm thereof, and hence the direction in which the operator is looking, is located in the half-space which comprises the front part of the vehicle.

Therefore, the rearward position of the turret corresponds to an angular movement thereof which brings the arm within the half-space that includes the rear of the vehicle, as traditionally understood.

Given that the turret is constrained in rotation around a vertical axis, every half-space has an angular amplitude of 180°.

The proposed system 1 comprises first of all a hydraulic transmission circuit 10 for connecting one or more main pumps 11 to one or more bi-directional hydraulic travel motors 12, the main pumps 11 being connected to an internal combustion engine M by means of power take-offs or the like.

Each hydraulic motor 12 is connected to translation means, such as a track or wheels or the like, with which the undercarriage is provided.

Preferably, the transmission circuit 10 is connected to two hydraulic motors 12, intended to drive the travel of respective tracks (or other translation means).

For each hydraulic motor 12, the transmission circuit 10 comprises a travel control distributor 13, hydraulically controlled and capable of varying the driving direction of the motor 12, so as to reverse the direction of travel of the track.

In practical terms, when the driving direction of the motors 12 is varied, the tracks vary the direction of travel of the undercarriage; the variation in the operation of the motors is controlled by a respective control distributor 13.

The control distributors 13 can be can be three-position, bi-stable normally-closed valves or other equivalent hydraulic devices.

In detail, each control distributor 13 and the respective motor are comprised within a respective sub-circuit, downstream of the associated main pump 11, and are joined by two branches 14, 15 in which the working fluid, for example mineral oil, flows.

The control distributor 13 comprises a first open position in which it permits the passage of the pressure of the main pump 11 into said branches of the sub-circuit, in a first direction through the hydraulic motor 12.

In this condition, the motor 12 drives the associated track in such a way that the undercarriage moves in the frontward direction of the machine.

The control distributor 13 also includes a second open position in which it reverses the flow of the pressure in the two aforesaid branches 14, 15, so as to reverse the direction of operation of the respective motor 12 and, consequently, the direction of travel of the track.

The system 1 further comprises a second circuit 20, connected to the transmission circuit 10 and disposed downstream of a pilot pump 200, which is designed to supply a pilot pressure S0.

The pilot pump 200 can itself be driven by the internal combustion engine M and, practically speaking, is disposed upstream of the second circuit 20 so as to supply it with working fluid at the pilot pressure S0.

The second circuit 20 includes command valve means 21, 22 for controlling the direction of travel, activatable by the operator; they can be of the type of valves actuated by pedals or joysticks or the like.

In practical terms, the command means 21, 22 are designed to switch the control distributors 13 by alternatively sending different command signals to the pilot pressure.

In the example illustrated in the figure, the valve means comprise two pairs of normally closed pilot valves 21, 22, each intended to control a respective control distributor 13.

In particular, within each pair 21, 22, one pilot valve, if duly actuated by the operator, is capable of sending a first command signal S1 to the control distributor 13, which moves it into the first open position, whereas the other valve is designed to send a second command signal S2, which switches the distributor into the second position.

Therefore, by acting on the pairs of pilot valves 21, 22 from inside the cab, the operator can move the vehicle in opposite directions and also steer.

According to a very important aspect of the invention, the second circuit 20 includes a reversing valve 23, which is hydraulically controlled and interposed between the pairs of pilot valves 21, 22 (or other command means) and the control distributors 13.

The reversing valve 23 is normally in a maintenance position, in which it maintains the above-mentioned command signals S1, S2 unchanged, and comprises a reversal position, in which it reverses the command signals S1, S2, so as to reverse the control logic of the two control distributors 13.

In practical terms, the reversing valve 23, in the reversal position, receives the first command signals S1 as input and sends them into the circuit branches in which the second signals S2 normally pass, and vice versa; therefore, it is as if it transformed the first signals S1 into the second signals S2 and vice versa.

The modes of use of the reversing valve 23 will be clear from the description of the operation of the invention.

The proposed system 1 advantageously comprises coordination means which are configured in such a way as to switch the reversing valve 23 based on the position of the turret and based on the command signals S1, S2 output by the pilot valves 21, 22.

The coordination means incorporate the logic for switching the reversing valve 23, which makes it possible to obtain an intuitive way of maintaining the direction of forward travel of the machine.

In the present description, two preferential embodiments of the invention will be disclosed.

A first version of the system 1, shown in FIGS. 1-6, envisages coordination means with an exclusively hydraulic operation, and which can consist solely of components of a hydraulic type.

In an alternative version, represented in FIG. 7, the coordination means have an electro-hydraulic operation.

The first version of the invention is described below from a structural viewpoint.

The coordination means comprise a hydraulic detection member 24, available downstream of the pilot pump 200, associated with the turret of the vehicle and comprising a plurality of configurations assumed based on the angular position of the turret relative to undercarriage.

In detail, the detection member 24 can have a first configuration, which it assumes when the turret is in a frontward position, and a second configuration assumed when the turret is in a rearward position.

In this case, from a functional viewpoint, the detection member 24 can be likened to a two-way, two-position valve, with an open and a closed position corresponding, respectively, to the above-mentioned second and first configurations.

Preferably, the detection member 24 is fashioned in a rotary joint that couples the turret to the undercarriage and is configured to act as a hydraulic valve component.

In this case, the rotary joint can be made like the one described in Italian patent application no MO2014A000102, of the same Applicant, which is thus incorporated by reference in the present description.

The coordination means of the invention moreover include a first logic valve 25, hydraulically controlled, to which the reversing valve 23 is subject.

Figure 2:
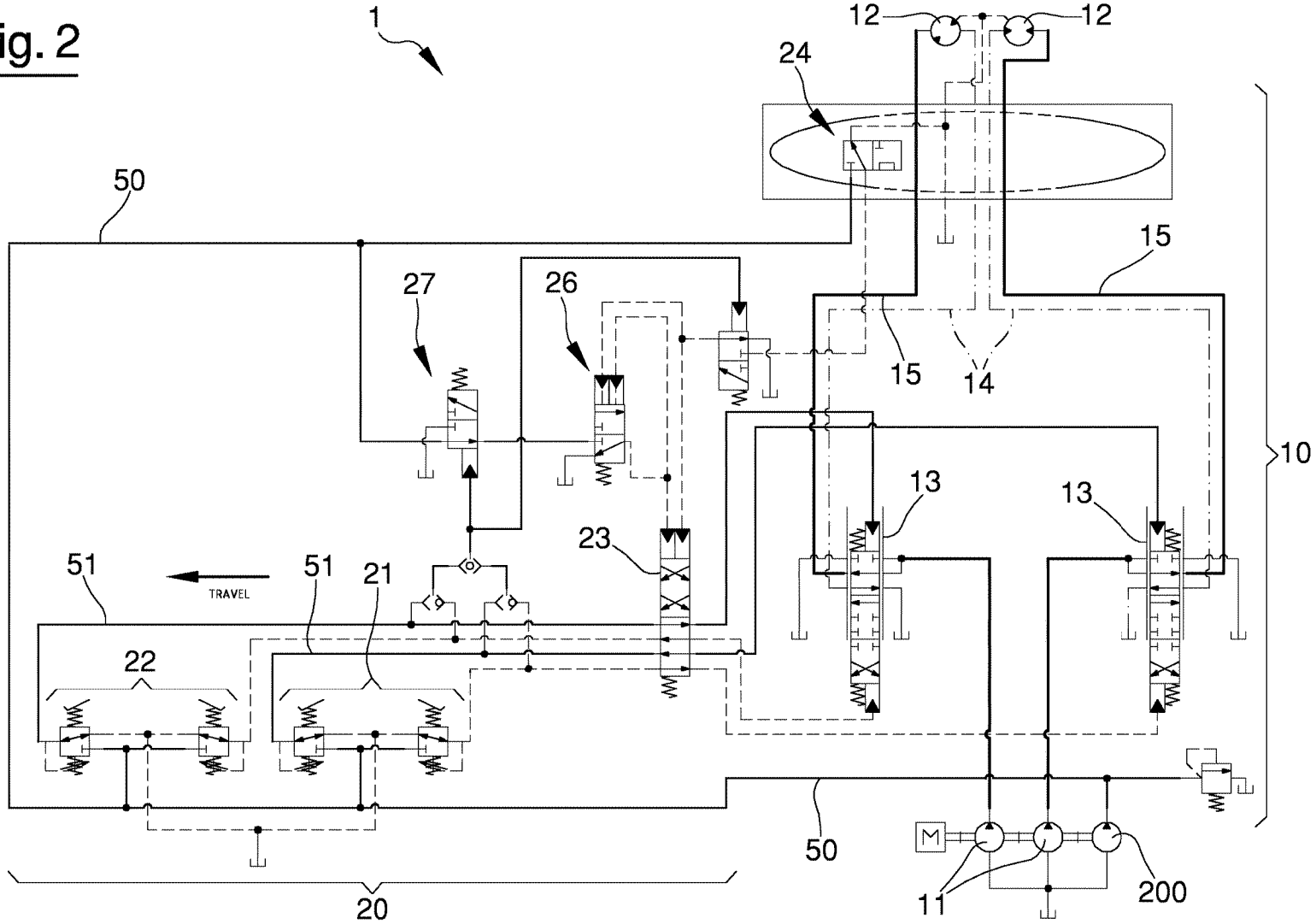

The first logic valve 25 can be a two-position valve movable between a supply position (e.g., as shown in FIG. 1) and a non-supply or return position (e.g., as shown in FIG. 2) and that is normally in the supply position. In its supply position, the first logic valve 25 is designed to send a first reversing signal S3, at the pilot pressure, which switches the reversing valve 23 into its reverse position.

In its second configuration, or open position, the detection member 24 allows the passage of the pilot pressure S0 to the first logic valve 25, which, if at its supply position, sends the aforementioned first reversing signal S3, which switches the reversing valve 23 into its reverse position.

Furthermore, after at least one of the command signals S1, S2 of the command means 21, 22 has been sent, the first logic valve 25 switches from its supply position (e.g., as shown in FIG. 1) to its return position (e.g., as shown in FIG. 2).

The reasons for this choice will be explained in the description of the operation of the proposed system 1.

The coordination means also comprise a second logic valve 26, hydraulically controlled, which is a two-position valve normally at a non-supply or return position (e.g., as shown in FIG. 1) and whose actuation is subject to the first reversing signal S3 of the first logic valve 25.

Figure 4:
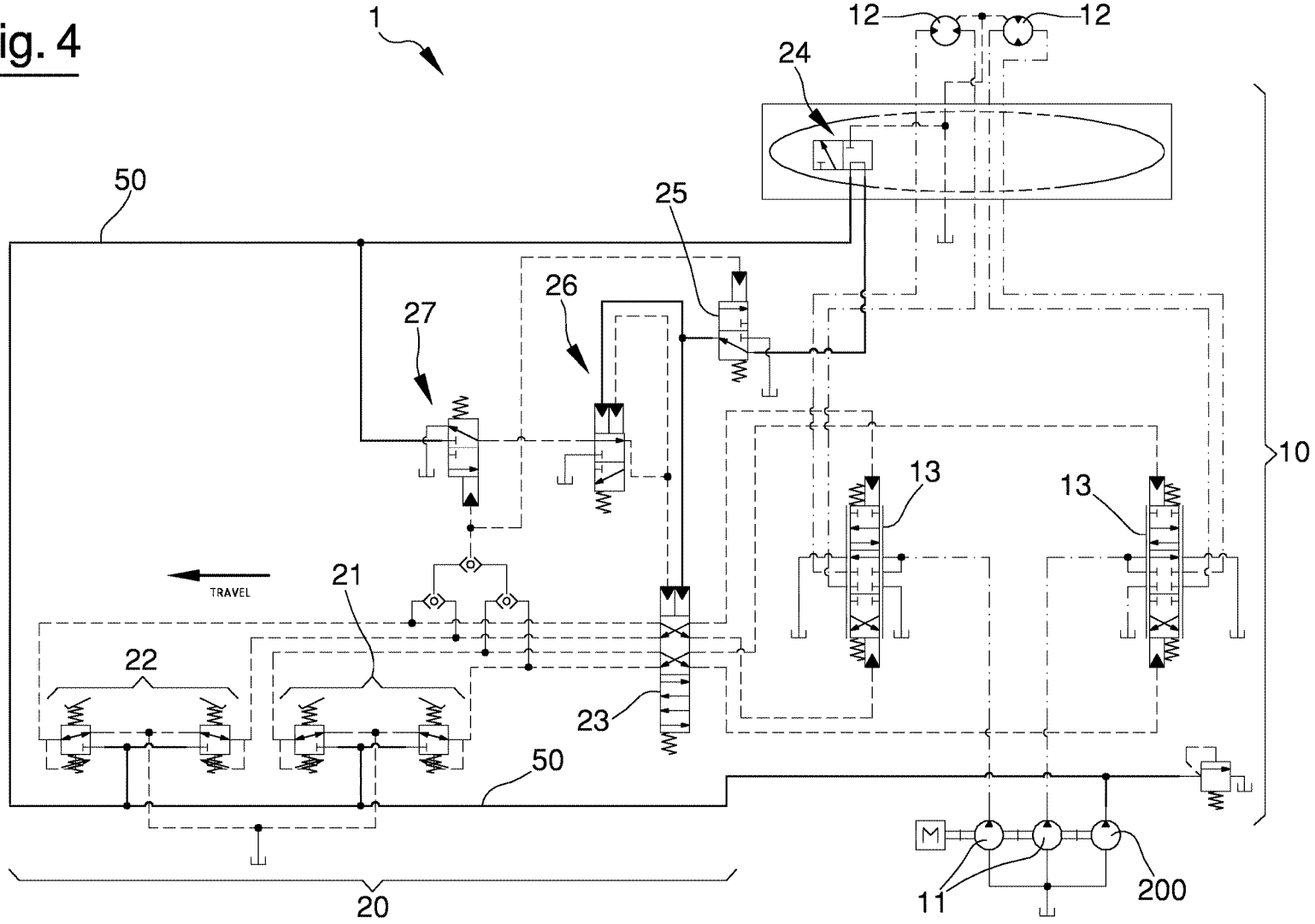

The second logic valve 26 comprises a supply position (e.g., as shown in FIG. 4), in which it allows a second reversing signal S4 to be sent, at the pilot pressure, which switches the reversing valve 23 into its reverse position and simultaneously keeps the second logic valve 26 itself at the supply position.

Furthermore, the coordination means include a third logic valve 27, which is a two-position valve normally at a non-supply or return position (e.g., as shown in FIG. 1), hydraulically controlled, subject to the command means 21, 22 and disposed downstream of the pilot pump 200.

The third logic valve 27 is disposed upstream of the second logic valve 26, and moves to a supply position (e.g., as shown in FIG. 2) after the command signals S1, S2 have been sent so as to allow the pilot pressure S0 to be sent to the second logic valve 26, so that, if the latter is at its supply position, the second reversing signal S4 will be transmitted to the reversing valve 23 so as to reverse the command signals S1, S2 sent by the command means 21, 22 toward the respective control distributors 13.

The operation of the first embodiment of the invention, illustrated above in structural terms, is described below with the aid of FIGS. 1-6.

FIG. 1 shows the condition in which the machine is stationary and the turret is in the aforesaid frontward position.

In this situation, the pilot pressure S0 reaches the command means 21, 22, the detection member 24 and the third logic valve 27.

However, the command means 21, 22 are not activated by the operator and thus the machine is not travelling; moreover, the detection member 24 is at its closed position and the third logic valve 27 is at its return position.

At this point, the operator acts on the command means 21, 22 in such a way as to drive the vehicle in frontward travel (see FIG. 2).

In detail, if the command means 21, 22 are for example connected to levers, the operator pushes them forward, in the intuitive position of forward travel.

Given that the reversing valve 23 is in its normal maintenance position, the first command signals S1 pass by it without being reversed so as to bring the control distributors 13 into their first open position, in which they actuate the hydraulic motors 12 so that they drive the undercarriage in the direction of forward travel.

Given that command signals S1 have been "emitted", the third logic valve 27 has moved to its supply position (e.g., as shown in FIG. 2) whilst the first logic valve 25 is at its return position (e.g., as shown in FIG. 2).

According to a very important aspect, if at this point as well, during travel, the operator rotates the turret by 180°, the direction of travel will not vary and the machine will continue moving so as to avoid, first of all, damages to the machine itself and also to prevent any interruption in the operations being carried out, such as conveyance or movement of materials.

Figure 3:
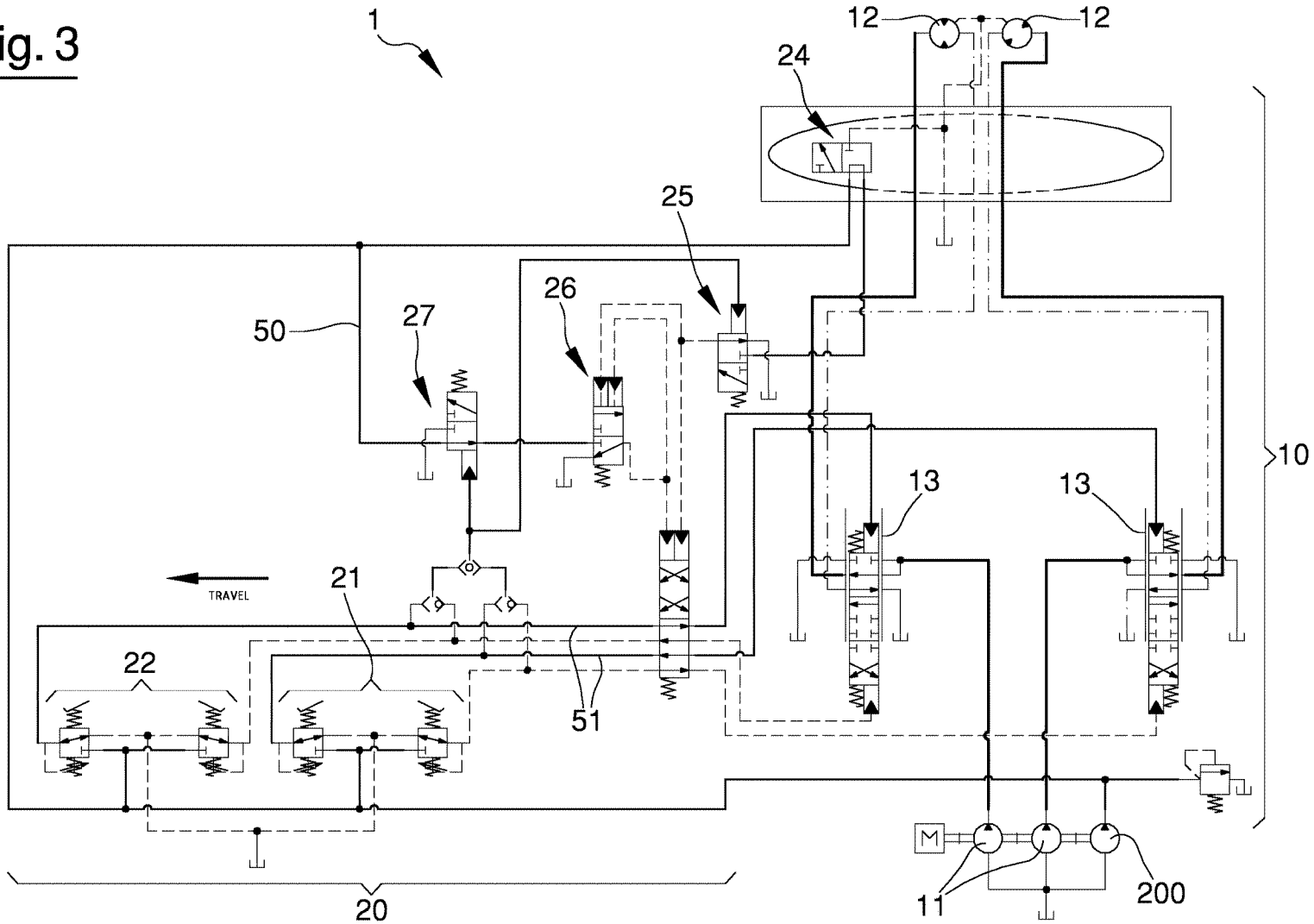

This advantageous function is shown in FIG. 3, where it may be seen that the detection member 24 is switched into the open position and sends a signal, at the pilot pressure S0, to the first logic valve 25, which, however, as explained above, is at its return position in this phase.

Given that the first valve is at its return position, the reversing valve 23 cannot move from the maintenance position, not only because it is not prompted by the first valve 25 itself, but also because the latter does not cause the second logic valve 26 to move to its supply position, which also has the pilot pressure S0 input to it.

When the vehicle stops, and the first command signals S1 cease, the system 1 enables the direction of frontward travel to be changed in an intuitive manner in accordance with the new position assumed by the turret, which is now disposed in what has been called the rearward position.

In fact, as shown in FIG. 4, as soon as the first command signals S1 disappear, the first logic valve 25 goes back into its supply position so that this time the pilot pressure S0 which passed through the detection member 24 can finally reach the reversing valve 23 in order to switch it into its reverse position.

According to a very important aspect, the same signal S4 which switched the reversing valve 23 moves the second logic valve 26 to its supply position.

If at this point, as shown in FIG. 5, the operator acts on the levers, moving them backwards so as to drive the undercarriage in the rearward direction relative to his view, the vehicle will move in the same direction in which it had moved before when the turret was in its frontward position.

In fact, in this situation, the third logic valve 27 moves to its supply position (see FIG. 5), since it is subject to the command signals (in this case the second signals S2), and sends the signal, at the pilot pressure S0, to the second valve 26, which, being at its supply position, can transmit to the reversing valve 23 the aforesaid second reversing signal S4, which maintains it in its reverse position.

It should be noted that, as explained above, the second reversing signal S4 also serves to keep the second valve 26 at its supply position.

Therefore, advantageously, even if in the meantime the first logic valve 25 is switched into the return position, the reversing valve 23 is kept in the reversal position and the second logic valve 26 remains at its supply position.

The second command signals S2 are reversed before reaching the control distributors 13, which are thus moved into their first open positions.

Relative to the direction of forward travel, in the event that the turret is in a frontward position, there will be the same direction of the pressure flow of the main pumps 11, and, consequently, the same direction of travel of the undercarriage.

However, from his own point of view, the operator is driving the vehicle in the reverse direction.

In this condition, if, during travel, the operator again rotates the turret, bringing it back into the frontward position, this will not cause any problems, because the vehicle will continue in the same direction of travel.

In fact, as can be seen in FIG. 6, the hydraulic detection member 24 is switched into its closed position but the signal S4 which maintains the reversing valve 23 in its reverse position comes from the second and third logic valves, which are both at their supply positions and hence the reversing valve 23 cannot switch.

When the operator releases the levers and the second command signals S2 are shut off, the system 1 is ready to identify a new direction of forward travel in accordance with the subjective position of the operator.

The structure of the second version of the aforesaid invention, wherein the coordination means are of an electro-hydraulic type, is described here below.

In detail, in this case, the reversing valve 23 differs from the one described above only in that it is electromagnetically actuated, as in the case, for example, of the solenoid valve 31 in FIG. 7.

The coordination means comprise a processing unit 30, to which the solenoid valve 31 is subject, and include a pressure sensor 32, which is connected to the processing unit and capable of detecting the emission of a command signal S1, S2 output by the command means.

Moreover, the coordination means comprise a position sensor 33 for detecting the angular position of the turret, which in FIG. 7 is represented in a stylized manner by the diagram T.

In alternative embodiments, the position sensor 33 can be replaced by other devices, also of a hydraulic type, provided that they are connected to a transducer which provides a suitable electrical signal to the processing unit.

For example, there is one possible embodiment wherein the position of the turret is detected via means of a hydraulic type, such as the member 24 described above, preferably consisting in the aforesaid rotary joint.

In practical terms, said means of a hydraulic type output a hydraulic signal, based on the position of the turret, which can be input to the transducer so as to provide a corresponding electrical signal to the aforementioned processing unit.

In any event, the processing unit 30—which can comprise a microprocessor or a microcontroller and a memory unit in which specific software resides—is configured to actuate the same operating logic as the first version of the invention explained above.

In practical terms, the processing unit 30 detects the position of the turret, and thus the frontward direction of the operator and, based on his actuation of the command means 21, 22, commands the reversing valve 23 to maintain the command signals S1, S2 unchanged or to reverse them.

In practical terms, the direction of forward travel of the vehicle is always of an intuitive type, i.e. it is that of the frontward subjective direction of the operator, except that, if during travel the turret is rotated by 180°, the travel will remain constant and will not be reversed until the vehicle is first stopped, so as to reset the command signals S1, S2.

It may be seen, therefore, that all of the drawbacks of the prior art are completely overcome by the system 1 of the invention, and in particular it shall be stressed that the operator of the vehicle has no need either to remember the relative position assumed by the turret relative to undercarriage or to rely on empirical or approximate references in order to infer the position or on other systems obliging him to make an assessment.

In fact, the invention automatically coordinates, in an intuitive manner, the direction of forward travel with the position of the turret relative to the undercarriage and hence with the position of the operator who is driving the hydraulic machine.

The invention claimed is:

1. A system for automatically coordinating a direction of travel with a position of a turret rotatably mounted on an undercarriage of a hydraulic machine comprising a hydraulic transmission circuit for connecting at least a main pump to at least a bi-directional hydraulic travel motor, the hydraulic transmission circuit including at least a travel control distributor able to vary a driving direction of the motor, the system comprising:

a second hydraulic circuit configured to be disposed downstream of a pilot pump providing a pilot pressure, the second hydraulic circuit including:

a valve controller for controlling the direction of travel, activatable by the operator and able to switch the control distributor by sending different command signals; and a reversing valve, interposed between the valve controller and the control distributor, the reversing valve having a maintenance position, in which the reversing valve maintains the command signals unchanged, and a reverse position, in which the reversing valve reverses the command signals; and a coordination circuit configured to switch or maintain the reversing valve according to the position of the turret and the command signals, the coordination circuit comprising a hydraulic detection member arranged downstream of the pilot pump, the hydraulic detection member taking on a first configuration or a second configuration based on an angular position of the turret.

2. The system according to claim 1, wherein the transmission circuit is connectable to two hydraulic motors intended to drive travel of respective translation means of the undercarriage, each hydraulic motor connected to a respective control distributor.

3. The system according to claim 1, wherein the coordination circuit further comprises a first logic valve to which the reversing valve is subject, the first logic valve having a supply position, the first logic valve configured to send, when in the supply position, a first reversing signal, which switches the reversing valve into its reverse position.

4. The system according to claim 3, wherein the hydraulic detection member takes on the first configuration when the turret is located at a frontward position, and wherein the hydraulic detection member takes on the second configuration when the turret is located at a rearward position, wherein the hydraulic detection member allows passage of the pilot pressure to the first logic valve when in its second configuration.

5. The system according to claim 3, wherein, after at least one command signal is sent by the valve controller, the first logic valve switches from the supply position to a non-supply position at which the first logic valve does not send the first reversing signal to the reversing valve.

6. The system according to claim 3, wherein the coordination circuit further comprises a second logic valve, which is normally at a non-supply position and subject to the first reversing signal of the first logic valve, the second logic valve comprising a supply position, the second logic valve configured to send, when in the supply position, a second reversing signal, which switches or maintains the reversing valve into its reverse position and simultaneously keeps the second logic valve at its supply position.

7. The system according to claim 6, wherein the coordination circuit further comprises a third logic valve, which is normally at a non-supply position and subject to the valve controller, available downstream of the pilot pump, and disposed upstream of the second logic valve, the third valve moving to a supply position after a command signal has been sent, so as to allow pilot pressure to be sent to the second logic valve.

8. The system according to claim 3, wherein the hydraulic detection member comprises a hydraulic valve component, the hydraulic valve component being at a closed position when the hydraulic detection member takes on the first configuration such that the hydraulic valve component does not allow passage of the pilot pressure to the first logic valve, the hydraulic valve component being at an open position when the hydraulic detection member takes on the second configuration such that the hydraulic valve component allows passage of the pilot pressure to the first logic valve.

9. The system according to claim 8, wherein the hydraulic valve component is at the closed position when the turret is at one of a frontward position or a rearward position and the hydraulic valve component is at the opened position when the turret is at the other of the frontward position or the rearward position.

10. The system according to claim 1, wherein the hydraulic detection member comprises a hydraulic valve component, the hydraulic valve component being at a closed position when the hydraulic detection member takes on the first configuration such that the hydraulic valve component does not allow passage of the pilot pressure therethrough, the hydraulic valve component being at an open position when the hydraulic detection member takes on the second configuration such that the hydraulic valve component allows passage of the pilot pressure therethrough.

11. The system according to claim 1, wherein the coordination circuit further comprises a first logic valve to which the reversing valve is subject, the hydraulic detection member configured to allow passage of the pilot pressure to the first logic valve upon taking on one of the first configuration or the second configuration, the first logic valve sending a first reversing signal to the reversing valve upon receipt of the pilot pressure from the hydraulic detection member, the first reversing signal switching the reversing valve into its reverse position.

* * * * *